United States Patent [19]

Hunke

[11] 4,107,971

[45] Aug. 22, 1978

[54] CLUSTER TYPE ROLLING MILL

[75] Inventor: Siegfried H. Hunke, Thomaston, Conn.

[73] Assignee: Textron, Inc., Providence, R.I.

[21] Appl. No.: 806,522

[22] Filed: Jun. 14, 1977

[51] Int. Cl.[2] ..... B21B 31/02

[52] U.S. Cl. ..... 72/237; 72/242

[58] Field of Search ..... 72/241-243, 72/237

[56] References Cited

U.S. PATENT DOCUMENTS

| | | | |
|---|---|---|---|
| 1,824,211 | 9/1931 | Jobke | 72/242 |
| 2,776,586 | 1/1957 | Sendzimer | 72/243 X |
| 3,528,274 | 9/1970 | Rastelli | 72/242 |
| 3,815,401 | 6/1974 | Sendzimer et al. | 72/242 |

*Primary Examiner*—Milton S. Mehr

*Attorney, Agent, or Firm*—DeLio and Montgomery

[57] ABSTRACT

A cluster type rolling mill having a housing characterized by exterior curvatures of the upper and the lower housing parts backing the roll cluster and being joined by four columns at the housing corners. The exterior shape of said upper and lower housing parts is comprised of two or three radii, curves or a combination thereof, so proportioning the dimensions of said parts as to minimize the sum of their non-parallel deflections and its effect upon the roll gap throughout the rolling width for one of the normal rolling conditions and to reduce the range thereof to a magnitude within the limits of adjustable compensation means. The result is the elimination of the need for deflection compensating roll contours.

6 Claims, 6 Drawing Figures

CLUSTER TYPE ROLLING MILL

This invention relates to rolling mills having rolls and backing elements arranged in a cluster, wherein the backing elements basically consist of arbors, casters and arbor supports.

The object of this invention is to provide improvements in these mills with a housing shape wherein the housing material is so distributed as to minimize non-parallel deflection of the housing and reduce the range of compensating adjustment, thus eliminating the need for deflection compensating roll contouring throughout the range of normal operating conditions.

While the principle of reducing the thickness of materials and elongating them between two rolls has not changed since its conception, different types of rolling mills have been developed to make the rolling of wider and more deformation-resistant flat stock to thinner final thicknesses possible and more economical.

In a two-high mill, having two rolls journaled and supported at their ends, the reduction in stock thickness is obtained by passing the stock between the rolls set apart to produce a gap under load equal to the desired exiting thickness of the stock. In the process the stock contacts both rolls over an area defined by the width of the stock and the arc formed by approximately one-half of the difference between the entering and the exiting stock thickness. Somewhat simplified, the roll separating force is the product of the mean deformation resistance of the stock times the roll contact area. Since the rolls have a basically constant area moment of inertia throughout the rolling width, they flex farther apart with increasing distance from their journaled and supported ends and the edges of the force-generating stock. The rolls are subject to non-parallel deflection, which can be compensated to some extent by gradually varying the roll diameter over the rolling width and beyond to produce a parallel roll gap under load and parallel stock, i.e., by deflection compensating roll contouring. The magnitude of such compensation is limited by the permissible roll stresses and by the adverse effect on the rolled product of the velocity differential created by the roll diameter variation.

Without such compensation the emerging stock will be thicker and shorter about its center, relative to the thinner and longer edge sections. Larger diameter rolls will increase the contact arc, the contact area and the roll separating force for a given pass.

The rolls of a four-high mill, all journaled at their ends, are arranged in a stack generally perpendicular to the rolling plane, with two rolls located on both sides thereof. The rolls contacting and elongating the stock, the work rolls, are of a relatively small diameter for a smaller contact arc and less roll separating force for a given thickness reduction and a given deformation resistance per contact area unit. The primary purpose of the journals at the end of the work rolls is to maintain the position of these rolls relative to the direction of the stock passage. The diameter of the outer rolls, the back-up rolls, is considerably larger than that of the work rolls for reason of lower stresses within these rolls and lesser non-parallel deflection of the total roll stack. The roll separating force is reacted by the mill housing via the roll gap adjustment means and the journals at the ends of the back-up rolls. Since the rolls must be of basically constant diameter throughout the rolling width, their area moment of inertia is basically constant as well. The magnitude of the non-parallel roll stack deflection over the rolling width is a function of the magnitude of the roll separating force per rolling width unit, the rolling width, the area moment of inertia of the rolls and the roll material modulus of elasticity. Contouring one or more rolls to compensate for the non-parallel roll deflection is common practice. Limits on contouring are the permissible stresses within the rolls and problems resulting from the diameter variation over the rolling width, i.e. the adverse effects of the velocity differential created thereby. Other limits encountered in the rolling of wider stock, having a high resistance against deformation, are the capacity of back-up roll journals and the flexing of the work rolls in the rolling plane in response to torsional moments and rolling stock tension differentials acting on the work rolls. With increasing distance from the work roll journals and the stock edges, the axis of the work rolls flexes farther away from the plane originally formed by the axis of all rolls. This work roll flexing in the rolling plane adds to the displacement caused by non-parallel roll deflection perpendicular to the rolling plane without necessarily being compatible in curvature. Larger diameter work rolls will increase the contact arc, the contact area, the roll separating force, etc.

Of the different mills intended to combine a large back-up area moment of inertia with small diameter, slender work rolls firmly held in place in the rolling plane, the cluster mill proved to be the most successful. In its simplest form, the six-high mill, two back-up rolls with axes generally equidistant and parallel to the rolling plane replace each of the two four-high mill back-up rolls. Each work roll is in contact with two back-up rolls, whereby a line from the point of roll contact with the rolling stock through the center of each work roll to the center of the respective back-up rolls has the shape of a Y. The branch lines of the Y represent roll separating force vectors acting upon the back-up rolls. The magnitude and the direction of these vectors depend on the magnitude of the roll separating force, the ratio between work roll and back-up roll diameter and the proximity of the two back-up rolls to each other. With increasing diameter ratio, the magnitude of the force vector toward each back-up roll approaches that of the total roll separating force. Larger ratios between work roll and back-up roll diameter and the provision of more back-up roll area moment of inertia were made possible with the introduction of the 12-high and the 20-high cluster mill. The 12-high mill has one work roll, two intermediate rolls and three back-up rolls on each side of the rolling plane. Each work roll is contacted and confined in the direction of the rolling plane by two intermediate rolls similar to the roll arrangement of a 6-high mill. Each intermediate roll contacts two back-up rolls for support and positional confinement. Favorable force vectors and a roll arrangement free of interference are primary factors in the selection of the intermediate roll diameter. In a 20-high mill, three more intermediate rolls take the place of the 12-high back-up rolls, and four back-up rolls are added for a total of 20 rolls. The back-up rolls of earlier mills having cluster type roll arrangements are journaled and supported at their ends similarly to the rolls of 2-high and 4-high mills. With all rolls having a basically constant area moment of inertia over the rolling and supporting width, the roll assemblies are subject to non-parallel deflection. Wider mills of this type engaged in the rolling of highly deformation-resistant stock require compensating roll contours of substantial magnitude often to the extent of adverse velocity differential effects.

Quite commonly among the earlier types of this mill, the reaction to the roll separating force vectors exerted by the ends of the back-up rolls via their journals is provided by frames hinged on one side and equipped with tie rods and roll gap adjustment means on the other. Lacking the counter-action of moments as occurring in a closed frame, the hinged frames contributed considerably to the overall elasticity of the mill, the mill spring.

One improvement in the construction of cluster type mills has been the replacement of the back-up rolls with backing elements, basically consisting of casters, arbors and arbor supports. Locating the arbor supports between all casters and directly adjacent to the end casters on an arbor made possible the housing reaction against the roll separating force vector of the backing elements at support spacings throughout the rolling and supporting width. The roll separating force limitations imposed on earlier mills by the capacity of roll end journals were also eliminated, because the backing elements provided casters over the entire rolling or supporting width, having a total capacity proportional to that width. The introduction of eccentric means located on the arbors and within the arbor supports for the purpose of adjusting the magnitude of the work roll gap made also possible the use of the single-piece mill housing. The housing reaction to the roll separating force vector of the backing elements throughout the rolling and supporting width at arbor support spacings is of primary importance, for, differing from the basically constant area moment of inertia of the back-up rolls throughout said width, the housing may be shaped to approximate a result of no non-parallel deflection in response to one specific rolling condition, and to minimize it for the normal range of such conditions.

Generally and assuming the rolling plane to be horizontal, the single-piece housing consists of an upper part and a lower part joined at the four corners between the openings for the stock passage and the roll assembly cavity by relatively short columns of large cross-sectional area. The size and the shape of the passage openings are determined by the width of the rolling stock and by functional attachments to the mill housing. The size and the shape of the roll assembly cavity are established by the dimensions of the roll cluster and the positions of its components relative to each other. The overall housing dimensions in the horizontal plane are thus defined by the maximum width of the rolling stock, the roll cluster selected, the permissible elastic column elongation under load, etc.

Earlier types of this housing have an exterior shaped by a multitude of plane surfaces arranged in the horizontal plane, the vertical plane and at various angles thereto. All surfaces are symmetrical in respect to the housing center axes. The upper and lower housing parts are shaped by plane and tapered surfaces originating at the four sides of the housing and terminating at a horizontal surface about the vertical center axis of the housing in an effort to provide a larger area moment of inertia at said axis and to reduce non-parallel housing deflection. Significantly, the housing cross-sections above and below the rolling stock passages remained parallel or near parallel, having a substantially constant area moment of inertia throughout the rolling and supporting width. Despite claims made in connection with this housing shape and with the exception of very narrow rolling widths, operating experience resulted in the necessity to provide not only one roll contour in compensation of the non-parallel housing deflection, but also several curvatures of different magnitude to effectively compensate the housing reaction for variations in rolling width and roll separating force.

Adjustable compensation for the non-parallel deflection of the mill housing was introduced, intended to eliminate the need for roll contouring throughout the range of normal rolling width and roll separating force variations. Individually adjustable secondary eccentric means were provided in the arbor supports of, initially, one backing element. Being of very limited effectiveness in only one backing element, these means were later incorporated in the two inner backing elements of the upper roll cluster, and drive provisions were made to permit compensating adjustments under load. While this adjustable compensation eliminated the need for the variety of roll contours in most mills, wider mills required at least one curved roll contour, strongly suggesting that the housing shape and the resulting proportioning of the area moments of inertia really satisfied none of the conditions within the normal range of mill applications. The purpose of said compensating means was somewhat negated by the mounting requirements for its drive. The upper housing center section in the direction of the roll cluster cavity, which was previously tapered to obtain a beneficial area moment of inertia proportioning, was made parallel to accommodate the compensating means drive. The asymmetry from top to bottom housing part resulted in different deflection curves for these parts, which in sum are often incompatible with the curvatures obtainable in conventional roll grinding. Consequently, a substantial portion of the adjustable deflection compensation has to be expended to remedy the condition caused by this asymmetry.

A housing shape differing from that of the earlier ones has recently been introduced (Sendzimer U.S. Pat. No. 3,815,401). This housing shape is determined in principle by two heavy side frames at the rolling stock passage ends of the housing and an upper and a lower traverse slab extending therebetween, being thickest at the center and tapered toward two sides, whereby the height of the side frames is at least substantially equal to the maximum vertical distance from the bottom of the lower slab to the top of the upper slab. The combined effect of the side frame and the slab deflections is asserted to be substantially constant throughout the operating length of the work roll and the range of normal operating conditions, such as differing rolling widths and roll separating forces. This housing shape supposedly requires zero crown for all conditions, i.e., no compensation for non-parallel deflection. Conventional beam theories have been cited in support of this claim.

The section height of the upper and lower part of a cluster mill housing varies substantially over the distance from the housing center to the stock passage faces because of the provisions necessary to envelope and support the roll cluster and to have openings suitable for the stock passage and the related attachments. The heavy side frames constitute an abrupt and additional drastic increase in the section height at locations remotest from the points of load application, the cluster cavity scallops. None of the conventional beam theories lends itself to determining, to any reasonable degree of accuracy, the deflection interaction of a beam having such abrupt and drastic changes in the area moment of inertia at various distances from the points of load application. Obviously, a relatively weak beam section in close proximity to the load will flex more in response to such load than a more remotely located stronger section of said beam, particularly when the translation from one beam section to the next one is abrupt. Contrary to the claimed combined effect of the frame and the slab deflections being substantially constant throughout the operating length of the work roll at various loads and their distribution, the theories agree that the shape and the magnitude of a beam deflection curve are affected by a change in the load and its distribution, which is in line with the need for different compensating roll contours experienced in earlier mills of this type. Also differing from the tapered slab beng thickest in the middle and the heavy side frames, application of the beam theories toward the shape of a beam approaching the state of no non-parallel deflection for a given load condition results in an area moment of inertia in the form of a curve over the length of the beam. More enlightenment in this regard is provided in the detailed description of the present invention.

The subject of the present invention is a housing shape for mills of the cluster type which so proportions the housing material as to minimize the non-parallel housing deflection affecting the gap between the work rolls over the rolling width, for one of the normal rolling conditions and for the range thereof to a magnitude within the limits of adjustable compensating means, thereby eliminating the need for deflection compensating roll contours.

The invention accordingly comprises the features of construction, combination of elements, and arrangement of parts which will be exemplified in the construction hereinafter set forth, and the scope of the invention will be indicated in the claims.

For a fuller understanding of the invention, reference is had to the following description, taken in connection with the accompanying drawings, in which.

Figure 5:
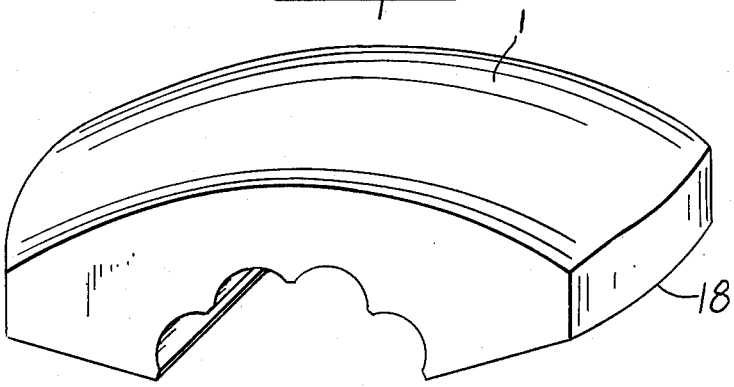
Figure 6:
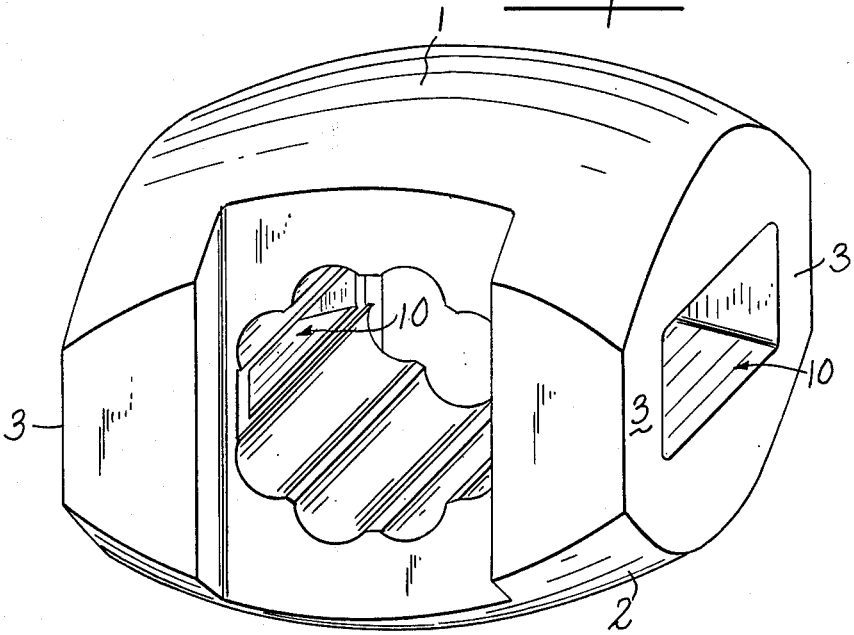

FIG. 5 exemplifies one optional shape of the upper housing portion according to the present invention in an isometric view as applying to both the upper and the lower housing portions, and FIG. 6 is an isometric view of a cluster mill housing according to the present invention.

Figure 1:
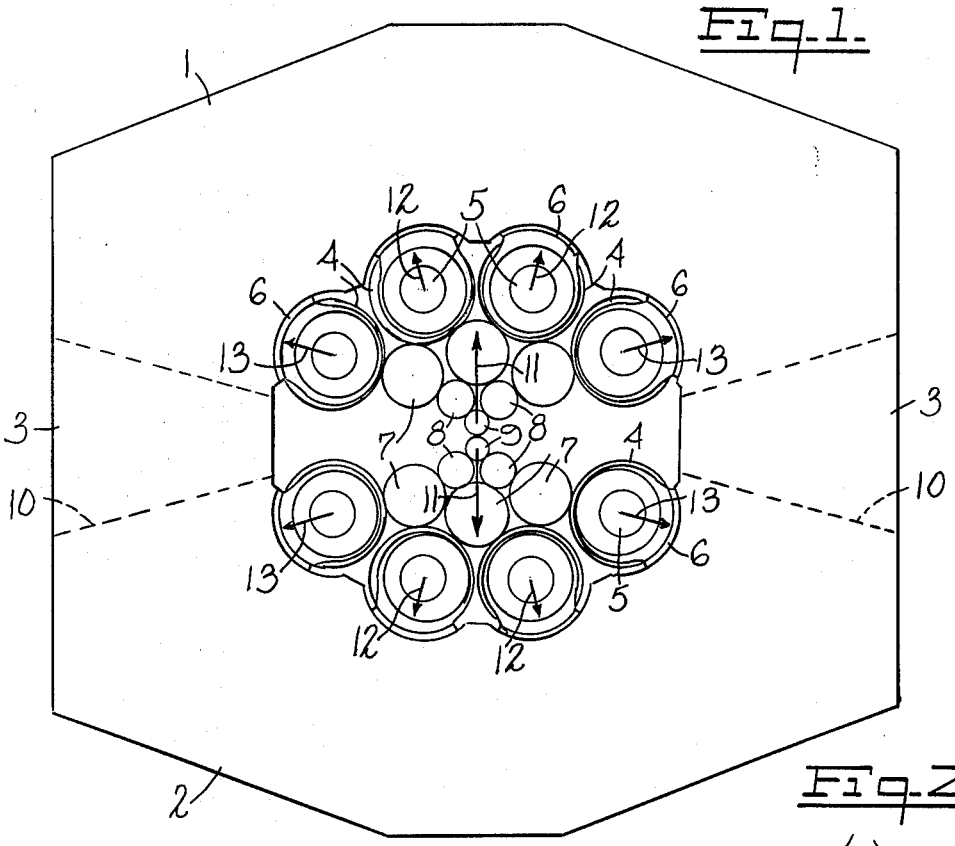
FIG. 1 shows a front view of a roll cluster within a closed frame housing; it bears indicia representative of the roll separating force and the force vectors derived therefrom as exerted by the backing elements.

Referring to the drawings, and particularly FIGS. 1 and 6, the housing as a whole is constituted by the upper housing part 1, the lower housing part 2 and the corner columns 3. The stock passage openings are shown at 10.

The work rolls 9 are backed by two inner intermediate rolls 8 and 8, outer intermediate rolls 7, which, in turn, bear on backing elements comprising casters 4, arbors 5 and arbor supports 6. The structural details of such backing elements are shown in Rastelli U.S. Pat. No. 3,528,274 to which reference may be made. The basic elements of the mill being thus identified, a review of the forces acting on the housing of a cluster mill and of the housing reaction to such forces will make the improvements provided with the present invention more readily understandable.

Figure 2:
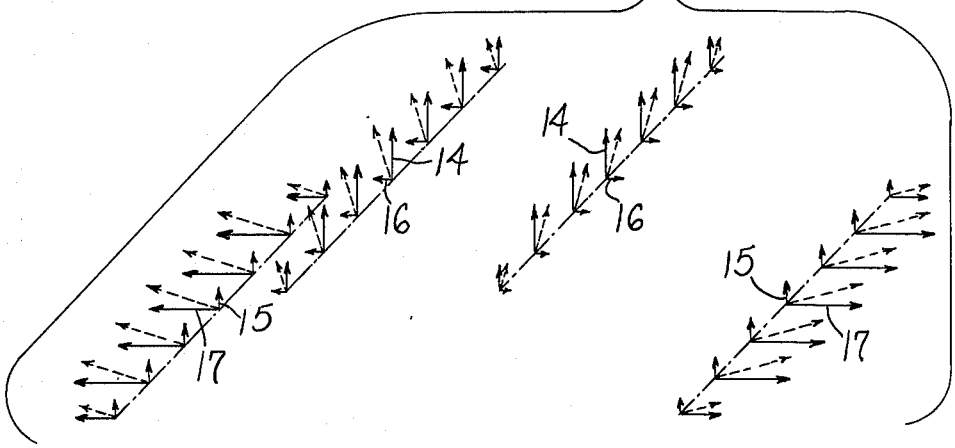
FIG. 2 is an isometric illustration of the force vectors as exerted by the individual arbor supports of the upper backing elements, also showing the horizontal and the vertical components of said force vectors.

Referring to the indicia represented on FIG. 1, the roll separating force 11 is transformed with the aid of elementary algebraic solutions of force systems via the center of the work rolls 9 and of the intermediate rolls 7, 8 into a force vector 12 exerted by the inner backing elements and a force vector 13 exerted by the outer backing elements. These force vectors 12, 13 represent the sum of the force vectors exerted on the individual arbor supports 6 as shown in FIG. 2. Also symbolized in FIG. 2 and obtained with the aid of elementary algebraic solutions of force systems are the vertical vector components 14, 15 and the horizontal vector components 16, 17.

For the purpose of evaluating the reaction of the closed frame housing to the acting forces in the plane faced in FIG. 1, the sum of the respective components 14, 16 of one backing element may be substituted for each vector 12, and, likewise, the sum of the respective components 15, 17 of one backing element may take the place of each vector 13. The housing portions above and below the roll cluster are then subjected to a moment, the forces of which are the sum of the vertical components 14 of each of the two inner backing elements and the sum of the vertical components 15 of each of the two outer backing elements. The housing portions to the left and to the right of the roll cluster are subjected to a moment, the forces of which are the sum of the horizontal components 16 of each of the two inner backing elements and the sum of the horizontal components 17 of each of the two outer backing elements. Theories dealing with the deflection of closed frames in response to forces, among them that by A. I. Zelikow for closed frame mill housings, agree that no side of a closed frame can respond to a moment with deflection without also causing the other sides of the frame to deflect as well, the deflection of the first side being diminished by the resistance against deflection exerted by the other sides. Accordingly, the moments acting on the horizontal housing portions encounter not only the resistance of said portions against deflection in the outward direction, but also the resistance of the vertical housing portions against deflection in the inward direction. Equally, the moments acting on the vertical housing portions encounter not only the resistance of said portions against deflection in the outward direction, but also the resistance of the horizontal housing portions against deflection in the inward direction. In summary, each moment is acting on a housing portion having a relatively large area moment of inertia over a short span and being subjected to a countermoment caused by the moments acting on the housing portions in the other ordinate. Only the difference between the effect of the moment and the countermoment can cause deflection of any housing portion in conjunction with a deflection of the housing portions in the other ordinate. Such difference can be, and generally is further reduced by selectively sizing the roll cluster components toward producing favorable vectors 12, 13 and by proportioning the short columns 3 between the roll cluster cavity and the stock passage openings 10 toward a suitable area moment of inertia. For the purpose of this consideration, the nonparallel deflection of the housing portions in the plane faced in FIG. 1 is negligible.

Such state of balance or near-balance of moments and counter-moments cannot be achieved in the vertical housing plane extending between the housing front faced in FIG. 1 and the back of the housing in the absence of forces acting in the horizontal plane toward the front and the rear of the mill housing. The vertical force components 14, 15 will stress the upper and the lower housing portions, and they will cause non-parallel deflection thereof unless these housing portions are shaped to resist such non-parallel deflection. Deviations from the ideal shape for a given load condition will result in vertical non-parallel deflection of the upper and the lower housing portions in response to the moments produced by the force components 14, 15, whereby the magnitude of this non-parallel deflection is reduced by the effect of the counter-moment then exerted by the resistance of the columns 3 against deflection.

In the horizontal plane extending between the housing front faced in FIG. 1 and the back of the housing, the horizontal force components 16, 17 will stress the upper and the lower housing portions, and they will cause non-parallel deflection thereof in this plane in response to the moments produced by the horizontal force components 16, 17 unless these housing portions are shaped to resist non-parallel deflection in reaction to that load condition.

Figure 3:
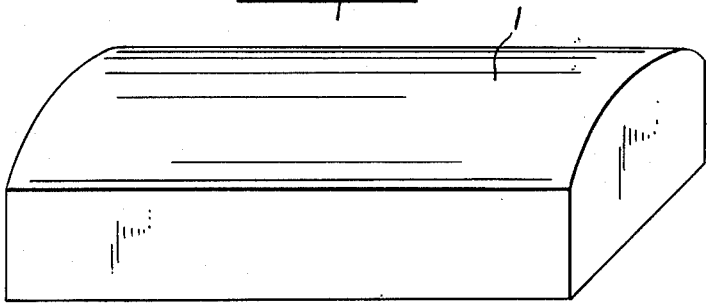
FIG. 3 shows an isometric view of a transitional phase of the upper housing portion toward the final shape, applying to both the upper and the lower housing portions.

A step-by-step explanation, beginning with the vertical force components 14, 15 and the deflection reaction of the upper and lower housing portions thereto, will serve toward a better understanding of the improvement provided with the housing shape according to the present invention. With the dimensions of these housing portions in the horizontal plane established within close limits by the related dimensions of the roll cluster cavity, the dimensions of the stock passage openings 10 and the desired cross-sectional area of the columns 3, conventional beam theories can be employed to determine the initial-step shape of the upper and lower housing portions in the vertical plane extending between the housing front faced in FIG. 1 and the back of the housing. A beam approaching the state of no non-parallel deflection throughout part of its span at a given load condition is one having throughout that part of its span an area movement of inertia proportioned to the deflection curve of a constant area moment of inertia beam resulting from such condition. Application of these theories toward such effect for the load condition represented by the vertical force components 14, 15 throughout their acting span provides for the initial-step proportioning of the area moment of inertia of the upper and lower housing portions in said vertical plane over that span. Setting a desirable stress equal to the maximum beam stress, the area moment of inertia curve is readily resolved to absolute dimensions. FIG. 3 shows the initial-step shape of the upper housing portion 1 as the result of these exercises, also applying to the lower housing portion.

Figure 4:
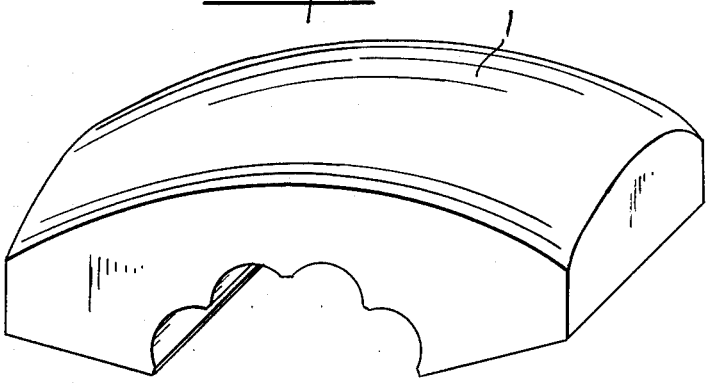
FIG. 4 illustrates in an isometric view another transitional phase of the upper housing portion toward the final shape, applying to both the upper and the lower housing portions.

FIG. 4 illustrates the second-step shape of the upper housing portion 1, which applies to the lower housing portion as well. Accommodating the need to envelope and support the roll cluster, the second-step shape closely maintains the area moment of inertia proportions of the initial-step shape throughout the span of the vertical force components 14, 15. Significantly, the exterior curvature of these housing portions over their width, providing for a most gradual transition, reduces the section height differences as necessitated by the provisions for the support or the backing of the roll cluster, and it avoids the accumulation of a large area moment of inertia in locations remote from the application of the vertical force components 14, 15. These provisions are essential in maintaining a predicability of the deflection response of the beams representing the upper and lower housing portions to the load and the span throughout which the forces are applied.

The final-step shape of the upper and lower housing portions deals with the moments produced by the force components 16, 17, acting in the horizontal plane extending between the housing front faced in FIG. 1 and the back of the housing, and with the non-parallel deflection over the span throughout which the force components 16, 17 are applied as will be caused in these housing portions at a given load condition, unless they are shaped to proportion their area moment of inertia toward resisting or off-setting the non-parallel deflection throughout said span in the horizontal plane at such load condition. Avoidance of the non-parallel deflection in the horizontal plane of these housing portions throughout said span can be accomplished by providing an exterior curvature in the horizontal plane and by reducing the exterior curvature in the vertical plane in proportion in the influence the dimensional changes in the horizontal plane have on the area moment of inertia proportions in the vertical plane. Integration of the area moment of inertia proportions required in the horizontal plane with those resulting from an unaltered or increased exterior curvature in the vertical plane leads to a curvature of lesser magnitude in the horizontal plane or the elimination of that curvature, whereby the non-parallel deflection in the horizontal plane is reduced and the balance is offset by compensating deflection in the vertical plane. FIG. 5 shows the upper housing portion 1 shaped according to the present invention having exterior curvatures 18 in the horizontal plane and integrated area moment of inertia proportions in both planes. Integration of the area moment of inertia proportions required in the horizontal plane with those resulting from an exterior curvature in the vertical plane of a magnitude increased to an extent which eliminates the exterior curvature 18 is exemplified in FIG. 6, showing a cluster mill housing shaped according to the present invention, having an upper housing portion 1 and a lower housing portion 2, the exterior shape of which is comprised of curves, as well as the housing columns 3 and the stock passage openings 10.

As will be obvious to those familiar with the deflection response of a beam to the application of a load, only the proportioning of the housing material or the area moment it represents to the deflection curve of a constant area moment of inertia beam as provided by the exterior housing shape according to the present invention will eliminate or minimize to a proportional curvature of minute magnitude non-parallel deflection throughout part of the beam span, the rolling or supporting width of the mill, at that load condition. Minor deviations from the ideal curvatures for one load or rolling condition or normal variations in the rolling conditions tending to cause non-parallel deflection of the curved-exterior housing portions 1, 2 will, in line with the theories dealing with the deflection response of closed frames, invariably be partially counteracted by the resistance of the columns 3 against a corresponding deflection. The economy of rolling suggests the utilization of a rolling mill at or near roll separating force and rolling width capacity. When rolling at somewhat less than design rolling width, the area moment of inertia of the roll stack comprising the work rolls 9, the inner intermediate rolls 8 and the outer intermediate rolls 7 will distribute the roll separating force beyond the rolling width to the adjacent arbor supports 6, thereby reducing the deflection effect the application of the roll separating force over less than the design rolling width would otherwise have. Consequently, a cluster mill housing shaped according to the present invention to approach the state of no non-parallel deflection for the design rolling condition provides a parallel or near-parallel gap between the work rolls 9 over the design rolling width, and it limits non-parallelism of the gap throughout the rolling width for such condition and the normal range of rolling conditions to a magnitude well within the capacity of the provided adjustable compensating means, thereby eliminating the need for roll contouring in compensation of non-parallel housing deflection exceeding the capacity of the adjustable compensating means as experienced in earlier housings of this type. An example of adjustable compensating means is shown in the Rastelli U.S. Pat. No. 3,528,274, cited above, comprising eccentric bearing discs keyed on a shaft such as arbor 5 herein.

While the housing shown in FIG. 6 is of integral structure as obtainable in the casting process, it may also consist of several parts joined together by fabrication methods to produce the same effect. Minor modifications of the housing shape as may, for instance, be necessitated by provisions for the mounting of attachments to the housing or the mounting and handling thereof shall not be construed to constitute a departure from the spirit and the teaching of the present invention.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

What I claim is:

1. A cluster type rolling mill having a housing comprising an upper part and a lower part, each generally rectangular in plan, four corner posts connecting said upper and lower parts, a roll cluster including a plurality of upper and lower backing elements, the shape of said upper and lower parts being defined by exterior curves, one in a plane of a backing element axis and perpendicular to the sides of the housing and another in a plane which is perpendicular to said axis, wherein each part acts as a curved beam, and the highest point of each part occurs at the vertical center axis of the housing.

2. A rolling mill according to claim 1 wherein the housing material in each of the upper and lower parts and the area moment of inertia section represented by said material is so proportioned to the deflection curve of a constant area moment of inertia section as to eliminate or minimize the non-parallel deflection throughout the rolling width of the mill under load.

3. A rolling mill according to claim 2 wherein the area moment of inertia proportions in the vertical plane of the upper and lower parts are integrated with the respective area moment of inertia proportions in the horizontal plane.

4. A rolling mill according to claim 1 wherein the backing elements include adjustable means for compensating non-parallel housing deflection.

5. A cluster type rolling mill having a housing comprising an upper part and a lower part, each generally rectangular in plan, four corner posts connecting said upper and lower parts and a roll cluster including a plurality of upper and lower backing elements, each upper and lower part having a convex outer surface and a roll cavity, each cavity being shaped to provide area moments of inertia proportioned to resist non-parallel deflections caused by rolling forces.

6. A cluster type rolling mill according to claim 5 wherein the roll cluster is 20-high, including four upper and four lower backing elements.

* * * * *